United States Patent [19]

Sherhandt

[11] 4,119,337

[45] Oct. 10, 1978

[54] SANITARY PICKUP AND DISPOSAL DEVICE

[76] Inventor: John Sherhandt, 0-153 Tunbridge Rd., Fair Lawn, N.J. 07410

[21] Appl. No.: 852,210

[22] Filed: Nov. 17, 1977

[51] Int. Cl.[2] ..... A01K 29/00

[52] U.S. Cl. ..... 294/1 R; 294/19 R

[58] Field of Search ..... 294/1 R, 19 R, 55, 19 A, 294/50.6, 50.8; 15/257.1, 257.3, 257.6, 257.7; 119/1

[56] References Cited

U.S. PATENT DOCUMENTS

| | | | |
|---|---|---|---|
| 3,606,436 | 9/1971 | Lynch | 294/19 R |
| 3,802,728 | 4/1974 | Giacopelli | 294/1 R |
| 3,901,544 | 8/1975 | Tucciarone | 294/19 R |
| 4,055,363 | 10/1977 | Mandich | 294/1 R |

*Primary Examiner*—James B. Marbert

*Attorney, Agent, or Firm*—Natter & Natter

[57] ABSTRACT

A self-cleaning sanitary pickup and disposal device, including a receptacle for holding a waste collection bag. Selectively displaceable collector blades capture material deposits within the waste bag which is sealed prior to disposal. A manually operable scraper blade attachment housed within the receptacle is slidable, upon removal of the waste bag, into an operational mode for cleaning the collector blades. An accessory brush attachment can also be used in substitution for the scraper blade. A reservoir containing a disinfecting or like fluid can be flushed through the receptacle and over the collector blades after each use.

15 Claims, 7 Drawing Figures

FIG. 4
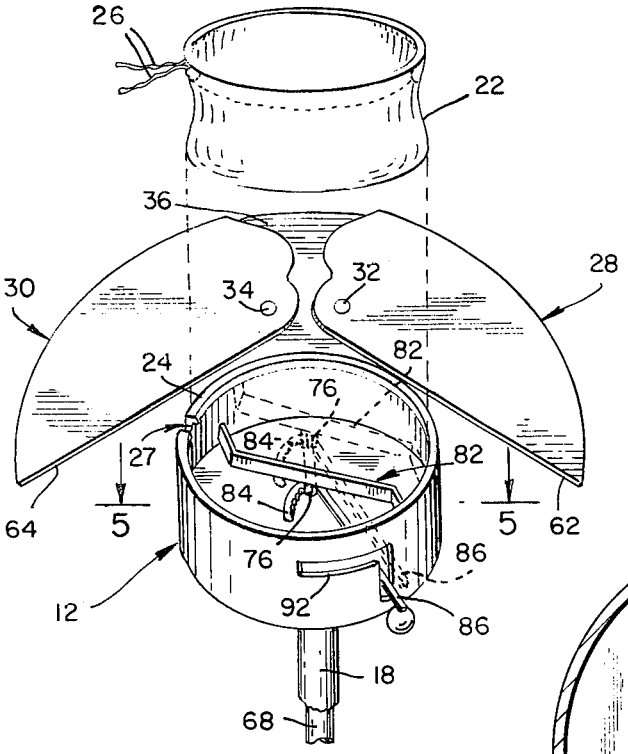
FIG. 5
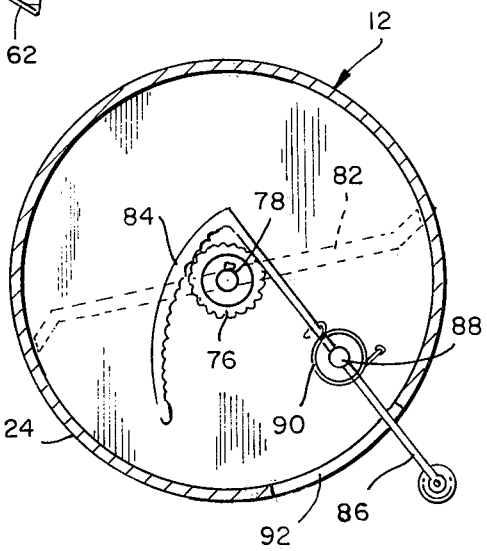
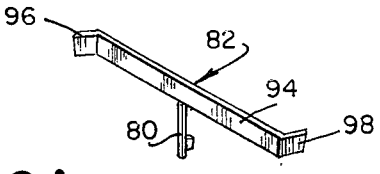
FIG. 6A
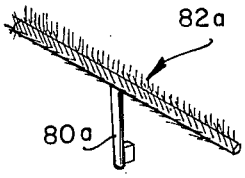
FIG. 6B

SANITARY PICKUP AND DISPOSAL DEVICE

BACKGROUND OF THE INVENTION

1. Field of the Invention

This invention is concerned with a hand-operated retrieving device and especially to a collecting receptacle for the sanitary pickup and disposal of refuse, garbage, animal excrement and other or similar offensive materials.

2. Description of the Prior Art

A recurrent problem of pet owners, especially for those who are city dwellers, is the effective disposal of pet droppings without littering curbsides, sidewalks and areaways. Within the past several years health officials have become more cognizant of the hazards incident with the indiscriminate littering resulting from pet droppings such as dog excrement. Furthermore, when these deposits occur on sidewalks, they create a nuisance and inconvenience to the passerby. As a result, communities and municipalities with ever increasing frequency have been enacting ordinances requiring the pet owner to clean up after his pet.

Several different types of devices have attempted to provide one with a convenient and sanitary method for complying with such ordinances. Many of these devices employ brooms, scoops or shovel-like implements for moving the deposits from a sidewalk or walkway and/or disposing of same at curbside. This, however, would not comply with most of the newer ordinances which require the materials to be removed and properly disposed of, such as by bagging and placing in a waste receptacle.

Other devices disclosed in the prior art such as U.S. Pat. Nos. 3,716,263, 3,937,509, and 4,042,269 do provide a separate and disposable bag within the pickup device. The bag and contents can then be disposed of in a sanitary manner. An inherent problem of such devices, however, is that they are difficult to manipulate in such manner as to quickly and efficiently load and then dispose of the waste in the collection bag. Some of these devices utilize a scooping, brushing, or sweeping action, whereas others employ a grappling or clamshell pickup operation. Such approaches have distinct shortcomings and in many incidents do not remove the entire deposit.

The present invention, in contrast, utilizes collecting blades adapted to slide under the material so as to capture same within a waste collection bag. Although this concept is generally shown in U.S. Pat. No. 3,606,436, there are distinct differences in the applicant's improved design utilizing an independent waste collection bag which can be sealed prior to disposal.

Another disadvantage of the prior art devices is that they do not provide an apparatus having self-cleaning features as in the present invention.

The pickup and disposal device of this invention overcomes many of these disadvantages and shortcomings of the prior art. The employment of a pair of pivotal collector blades which close over the mouth of a receptacle provide for effective loading of a waste receptacle bag. Furthermore, the bag can be completely sealed prior to removal from the receptacle. In addition, a feature of this invention is that it includes an integral cleaning mechanism and liquid flushing system.

SUMMARY OF THE INVENTION

Briefly, the nature of this invention concerns a hand-held manually operable pickup and disposal device. The intended purpose of this device is to provide an apparatus for the sanitary removal of waste deposits such as pet droppings, however other applications thereof will be apparent.

The device of this invention includes a receptacle being open at one end and closed at its opposed end. The receptacle is designed to accommodate an expendable waste collection bag. The mouth of the bag is so positioned as to coincide with the intake opening of the receptacle. A pair of resiliently urged collector blades are pivotally mounted contiguous to the open end of the receptacle. The collector blades are selectively displaceable from a preset initial spring-loaded position adjacent the open end of the receptacle to a pickup position wherein the opposed forward edges of the respective collector blades are in abutting contact with each other and overlying the intake opening of the receptacle.

In a typical application, the intake opening of the receptacle is located above a deposit of waste matter and is then lowered to the ground surface thus surrounding or enveloping the material. The collector blades which have been preset to a spring-loaded position are then released. As the leading edge of the respective blades approach each other and eventually come into abutting contact they slide under the waste material and the cooperative action of the collector blades captures the matter in the waste collection bag. The receptable is inverted, and the mouth of the waste collection bag is constricted by pulling the drawstring. The collector blades can then be opened so as to permit removal of the sealed bag.

An important feature of this invention concerns the self-cleaning aspect and includes a cleaning mechanism housing within the receptable which is slideable into an operational position upon removal of the waste collection bag. The cleaning mechanism includes a manually operated scraper blade and interchangeable brush attachement adapted for rotary motion. The blade wipes the inner periphery of the receptacle, as well as the upper surface of the collector blades. Further in conjunction with this cleaning procedure, a detergent or like fluid can be released from a squeeze bottle reservior for flushing the loosened waste material from these components. By opening the collector blades the flushing liquid and suspended waste material are released.

Having thus summarized the invention, it will be seen that an object thereof is to provide a sanitary pickup and disposal device of the general character described herein.

Specifically, it is an object of this invention to provide a sanitary pickup and disposal device having a receptacle with an open end and a selectively movable pair of collector blades in sliding contact with the open end, for displacement under the waste material and across the open mouth of the receptacle to contain the waste material.

Another object of this invention is to provide a sanitary pickup and disposal device including a waste collection bag positionable within the receptacle and adapted to be sealed after loading and prior to removal from the receptacle.

It is a further object of this invention to provide a sanitary pickup and disposal device having a self-cleaning scraper and a brush attachment for contacting the inner periphery of the receptacle and collector blades.

A still further object of this invention is to provide a sanitary pickup and disposal device having a reservoir for holding a sanitizing disinfectant or like liquid agent for flushing the loosened material from the receptacle and collector blades.

Other objects of this invention in part will be apparent and in part will be pointed out hereinafter.

With these ends in view, the invention finds embodiment in certain combinations of elements, and arrangements of parts, by which the objects aforementioned and certain other objects are hereinafter attained, all as more fully described with reference to the accompanying drawings, and the scope of which is more particularly pointed out and indicated in the appended claims.

BRIEF DESCRIPTION OF THE DRAWINGS

In the accompanying drawings in which is shown the preferred embodiment of the invention:

FIG. 4 is a partial perspective view shown in exploded fashion with the waste collection bag, the cleaning mechanism, and the scraper blades in a storage position (solid lines) and in an operational position (broken lines);

FIG. 5 is a sectional view to a slightly enlarged scale taken along line 5—5 of FIG. 4 and illustrating a gear arrangement including a manually operating lever for rotating a scraper blade;

FIG. 6A is an isolated perspective view of the scraper blade adapted for removable installation; and FIG. 6B is an isolated perspective view of a brush attachment which may be interchangeably substituted for the scraper blade.

DESCRIPTION OF THE PREFERRED EMBODIMENTS

Figure 1:
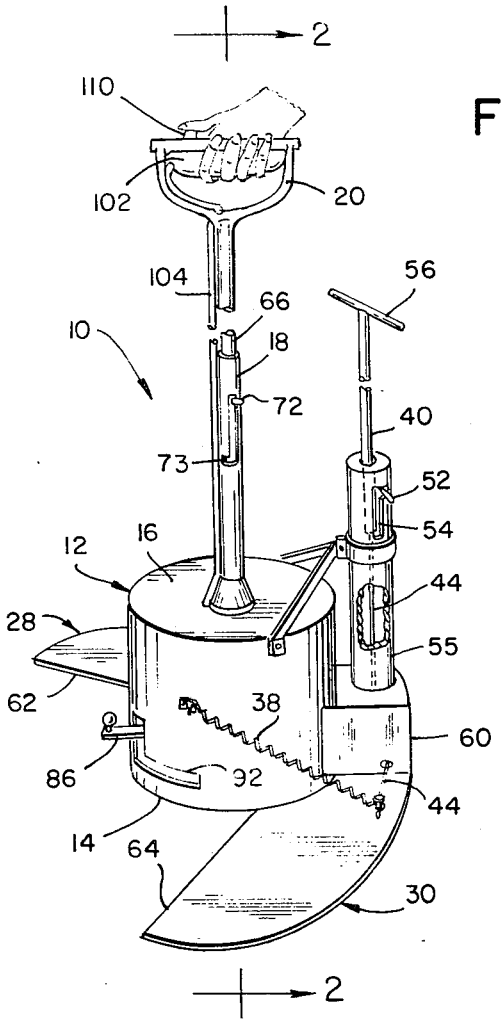
FIG. 1 is a perspective view of a sanitary pickup and disposal device of this invention showing the collector blades in an open position.

Referring now in detail to the invention, the reference numeral 10 denotes generally a sanitary pickup and disposal device constructed in accordance with and embodying the invention. The pickup device 10 will hereinafter be discussed in connection with its application for the cleanup after pets, however it should be understood that this device can suitably be used for the sanitary removal and disposal of other similarly offensive material.

The pickup device 10, as typically illustrated in FIG. 1, is comprised of a receptacle 12 which in this preferred embodiment is in the form of a cylindrical container having an intake opening 14 and a closed end 16. A hollow tubular casing 18 extends vertically upward from the closed end 16 of the receptacle 12 and terminates at a hand grip 20. The hand grip 20 is designed to extend approximately to the height of an ordinary walking cane or about 61–66 cm. (24–26 inches). The receptacle 12 as shown is approximately 10–15 cm. (4–6 inches) in diameter and about 10 cm. (4 inches) in length. The pickup device 10 is preferrably assembled from a lightweight noncorrosive material such as aluminum, plastic and the like.

The receptacle 12 is adapted for accommodating a waste collection bag 22 as shown in FIG. 4. The margin defining opening 14 is turned inwardly forming a lip 24 for retaining the waste collection bag 22. The bag 22 is expanded and then inserted into receptacle 12 with the edge of the bag mouth resting upon the lip 24 (see FIG. 2). The waste bag 22 of this preferred embodiment also includes a drawstring 26 for constricting the mouth of the bag 22 prior to removal from within the receptacle 12. For accomplishing this the lip 24 is provided with a notch 27 through which the drawstring 26 can be extended and pulled to seal the bag 22. The waste bag 22 is intended for disposable use and can, for example, be fabricated of biodegradable paper, polyethylene or similar material.

A pair of collector blades 28, 30 are pivotally displaceable over the intake opening 14 of receptacle 12. The blades 28, 30 are comprised of planar elements approximately 0.1 to 0.15 cm. (1/32 inch) in thickness and ar respectively attached by a pin connection 32, 34 to an extension plate 36 projecting rearwardly from the receptacle 12. The extension plate 36 is substantially coplanar with the plane of the opening 14, and the upper surface of the respective blades 28, 30 is in sliding contact with the lip 24 during movement.

The collector blades 28, 30 are resiliently urged towards each other by yieldable elements typically shown as open helical tension springs 37, 38. The blades 28, 30 are initially preset in an open spring-loaded position illustrated by phantom lines in FIG. 3. This is achieved by exerting an upward force on a pull-rod 40. The upward movement of the rod 40 is transmitted to the respective collector blades 28, 30 by cables 42, 44 which move in the direction shown by the arrows. The cables 42, 44 are affixed to the collector blades 28, 30 at points 46, 48, and the distal ends thereof are attached to pull-rod 40 at 50. The rod 40 is slidably mounted within a sleeve 55 and has a tab 52 which rides in a slotted opening 54. By rotating a handle 56 around the longitudinal axis of rod 40, the tab 52 can be used to lock and conversely release rod 40 from its preset spring-loaded position. The cables 42, 44 engage respective guide pulleys 56, 58 for effectively changing the upward vertically applied force to a substantially horizontal direction being applied at points 46, 48 in the plane of the respective blades 28, 30. The guide pulleys 56, 58 are enclosed within a housing 60 so as to prevent grass, shrubbery, leaves, or other foreign materials from interfering with the pulley or cable operation. Release of the tab 52 permits the blades 28, 30 to move toward each other such that their leading edges 62, 64 will come into abutment. As the leading edges 62, 64 traverse along the horizontal ground surface they will slide under the material to be picked up, typically illustrated by numeral 100 in FIG. 2. The receptacle 12 is then inverted, thus allowing the material 100 to fall into the waste bag 22.

Figure 2:
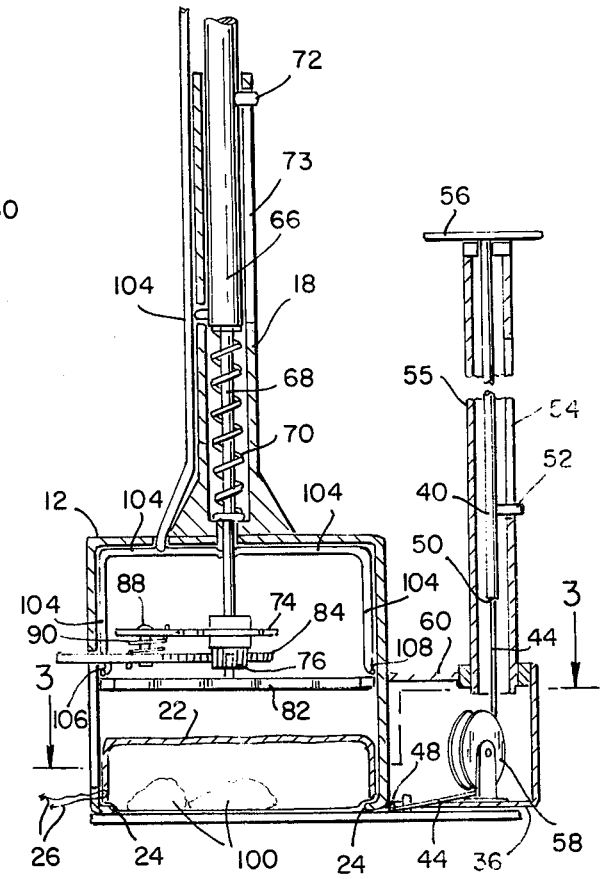
FIG. 2 is a longitudinal sectional view slightly enlarged, taken substantially along line 2—2 of FIG. 1, showing the placement of a waste collection bag and a cleaning mechanism housed within the receptacle.
Figure 3:
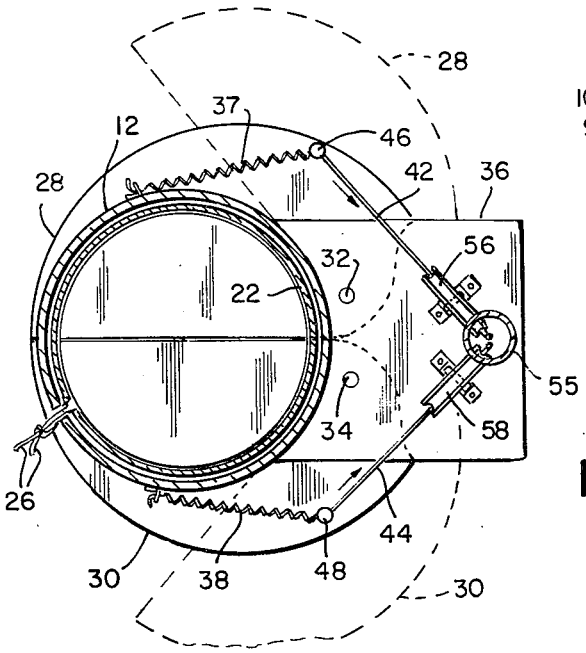
FIG. 3 is a sectional view taken substantially along line 3—3 of FIG. 2 showing the operation of the collector blades, the blades appearing in a closed position by solid lines and in an open position by the broken line illustration.

Considering next the cleaning mechanism which is housed within the upper portion of the receptacle 12, FIG. 2 shows a slidable shaft 66 within tubular casing 18. The shaft 66 has an area of a reduced diameter 68 being surrounded by an open helical compression spring 70. The upper end of the shaft 66 has an operating lever 72 projecting through a slotted opening 73 in casing 18. A perforated plate 74 is threadably attached to the lower end of the shaft 66, and a pinion gear 76 is affixed at the terminal end thereof. The gear 76 is provided with a keyway 78 for accepting a stem portion 80 of a scraper blade 82.

Rotary movement of the scraper blade 82 is effectuated by means of the engagement of a toothed rack 84 with the teeth of the pinion gear 76 during manual reciprocal movement of an extension arm 86. The arm 86 projects externally from receptable 12 and is pivotally secured to the perforated plate 74 by a pin connection 88 and additionally is provided with a wire spring 90 for returning the extension arm 86 to its initial position. It should be apparent that the compression spring 70 will normally urge the scraper blade 82 and gear components to a storage position clear of the waste collection bag 22 when not being used. This position is illustrated in solid lines in FIG. 4. After the waste collection bag 22 has been removed, cleaning is effectuated by applying pressure to operating lever 72 against the force of spring 70. The blade 82 can be releasably locked by securing the lever 72 in the slotted opening 73. Similarly, the extension arm 86 will be displaced in a passageway 92 during movement of shaft 66.

The scraper blade 82, as shown in FIG. 6A, is provided with a straight portion 94 and terminates at opposed ends with articulated flaps 96, 98. These flap portions 96, 98 are adapted to contact the inner margin of opening 14, whereas the straight portion 94 contacts the upper surface of blades 28, 30..

FIG. 6B shows an alternate brush attachment 82*a* containing a stem portion 80*a* for insertion in the keyway 76. It should be apparent that either or both of the scraper blade 82 or brush attachment 82*a* may be interchangeably used, with the selection being made prior to use of the device. It should be further pointed out that the straight portion 94 including the flap portions 96, 98 can be made of a hard rubber or thermoplastic substance. The brush 82*a* is preferably constructed with wire or nylon bristles.

The pickup and disposal device 10 also incorporates a refillable liquid reservoir in the form of a flexible plastic wall "squeeze" container 102 mounted within the hand grip 20. A tubular conduit 104 leading from the container 102 is directed along casing 18 and through the closed end 16 of receptacle 12. The conduit 104 is bifurcated and provided with spray nozzles 106, 108 at the point of discharge. The fluid contents within container 102 can be selectively released by operation of a push valve 110, while simultaneously applying gripping pressure to collapse the container 102 and force liquid through the spray nozzles 106, 108.

In operation, the preferred procedure is to initially preset the collector blades 28, 30 by pulling up on handle 56 and rotating to lockingly engage tab 52 within the slot 54. A collection bag 22 is then opened and inserted behind lip 24 with the drawstring 26 extending through the notch 27. The receptacle 12 is then located above the pet droppings and lowered to the ground surface to envelop the deposit 100. The handle 56 is then rotated to release tab 52; the spring-loaded collector blades 28, 30 will then move towards each other and close the intake opening 14 of the receptacle 12. The material deposit 100 will then be trapped within the waste collection bag 22. The device 10 is inverted so that the deposit 100 will fall into the waste bag 22, and then the drawstring 26 is pulled tightly to seal bag 22 with the contents therein. The collector blades 28, 30 are then opened so that the bag 22 can be removed and disposed of. After each such collection, the collector blades 28, 30 and the interior of receptacle 12 can be cleaned in the following manner. The scraper blade 82 and operating mechanism stored in the upper portion of the receptacle 12 is lowered and locked into position by using lever 72 which is moved against the force of spring 70 into engagement with the slotted opening 73. The scraper blade 82 is then rotated by means of arm 86 and will remove any material that has adhered to the upper surface of blades 28, 30. Alternatively, the brush attachment 82*a* can be interchangeably inserted prior to inserting the waste bag 22.

In order to effectively flush the loosened solid material deposits, a flushing fluid such as liquid detergent, which can also include a disinfectant, sanitizing agent, deodorizing substance or similar additive, previously placed within container 102 can be discharged through spray nozzles 106, 108. The collector blades 28, 30 are then opened to permit for an outflow of the wash solution.

Thus, it will be seen that there is provided a sanitary pickup and disposal device which achieves the various objects of the invention and which is well adapted to meet the conditions of practical use.

Since various possible embodiments might be made of the present invention and various changes might be made in the exemplary embodiments above set forth, it is to be understood that all material shown and described in the accompanying drawings is to be interpreted as illustrative and not in a limiting sense.

Having thus described the invention, there is claimed as new and desired to be secured by Letters Patent:

1. A santiary pickup and disposal device for removing animal waste deposits comprising a receptacle, said receptacle having an intake opening, said intake opening lying within a plane, collector blade means adapted for movement substantially within the plane of said intake opening, said collector blade means being selectively displaceable from an initial open position beyond a margin of said opening to a closed position contiguous to and overlying said opening, said receptacle being adapted for removal of waste deposits by envelopment of said deposits within the intake opening and by the cooperative action of the collector blade means being slidable under the waste deposit for capturing same within the receptacle and further incorporating cleaning means within the receptacle for contacting said collector blade means to dislodge any substances adhering to said blade means.

2. A sanitary pickup and disposal device for removing animal waste deposits as claimed in claim 1, further including a waste collection bag, said waste collection bag being adapted for accommodation within the intake opening of the receptacle with the bag mouth conforming to the margin of the intake opening for receiving said waste deposits material.

3. A sanitary pickup and disposal device as claimed in claim 2 wherein the margin of the intake opening is provided with an inturned lip, said lip providing retaining means for securing the waste collection bag within the receptacle.

4. A sanitary pickup and disposal device as claimed in claim 2 wherein the waste collection bag includes constricting means for sealing the bag mouth after the collector blade means are i a closed position prior to removal of the bag from the receptacle.

5. A sanitary pickup and disposal device as claimed in claim 1 wherein the collector blade means includes two pivotally mounted blades, the blades being selectively releasable and resiliently urged into abutting contact with each other.

6. A sanitary pickup and disposal device as claimed in claim 5 further including force vector directional modifying means for transmitting a vertically applied force to the plane of the collector blades.

7. A sanitary pickup and disposal device as claimed in claim 6 wherein the force vector directional modifying means includes a guide pulley and the force transmitting means includes a cable fixed at one end to the collector blade, the distal end of said cable being attached to a vertically slidable rod.

8. A sanitary pickup and disposal device as claimed in claim 1 wherein said cleaning means is displaceable within the receptacle from a storage position to an operational mode contiguous to the collector blade means for removing waste deposits adhering to the collector blade means.

9. A sanitary pickup and disposal device as claimed in claim 8 wherein said cleaning means includes a scraper blade, said scraper blade being mechanically linked to an operating arm, said arm being manually operable for rotating the scraper blade.

10. A sanitary pickup and disposal device as claimed in claim 9 further including a brush attachment, said brush attachment being interchangeable with the scraper blade.

11. A sanitary pickup and disposal device as claimed in claim 9 wherein the operating arm projects externally from the receptacle to permit remote operation of the scraper blade.

12. A sanitary pickup and disposal device as claimed in claim 9 wherein the scraper blade includes a flap portion at its opposed ends, said flap being adapted for wiping contact with the margin of the receptacle.

13. A sanitary pickup and disposal device as claimed in claim 1 further including a liquid flushing system, said flushing system including a fluid reservoir, and conduit means for directing a fluid flow from said reservoir into the receptacle.

14. A sanitary pickup and disposal device as claimed in claim 13 further including nozzle means mounted within the receptacle for directing discharge flow from the conduit onto the collector blades.

15. A sanitary pickup and disposal device as claimed in claim 13 wherein the fluid reservoir is formed of a flexible wall container adapted for pressurized discharge of the liquid contents.

* * * * *